US008376542B2

(12) United States Patent
Pedemonte et al.

(10) Patent No.: US 8,376,542 B2
(45) Date of Patent: Feb. 19, 2013

(54) PRE-HEATING PRINT MEDIA

(75) Inventors: Xavier Soler Pedemonte, Barcelona (ES); Jesus Garcia Maza, Terrassa (ES); Antonio Monclus Velasco, Castelldefels (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 221 days.

(21) Appl. No.: 12/819,714

(22) Filed: Jun. 21, 2010

(65) Prior Publication Data

US 2011/0310203 A1 Dec. 22, 2011

(51) Int. Cl.
*B41J 2/01* (2006.01)
*B41J 29/38* (2006.01)

(52) U.S. Cl. ..... 347/102; 347/16

(58) Field of Classification Search ..... 347/2
See application file for complete search history.

(56) References Cited

U.S. PATENT DOCUMENTS

| | | | | |
|---|---|---|---|---|
| 5,371,531 | A * | 12/1994 | Rezanka et al. | 347/43 |
| 5,864,354 | A * | 1/1999 | Hibino et al. | 347/212 |
| 6,425,663 | B1 * | 7/2002 | Eastlund et al. | 347/102 |
| 6,508,552 | B1 * | 1/2003 | Steinfield et al. | 347/102 |
| 6,612,691 | B1 * | 9/2003 | Koitabashi et al. | 347/105 |
| 6,783,226 | B2 | 8/2004 | Szlucha | |
| 6,786,589 | B2 * | 9/2004 | Suzuki et al. | 347/102 |
| 6,834,948 | B2 * | 12/2004 | Asano et al. | 347/102 |
| 7,137,694 | B2 * | 11/2006 | Ferran et al. | 347/102 |
| 7,748,837 | B2 * | 7/2010 | Kremers | 347/102 |
| 2003/0142187 | A1 * | 7/2003 | Elgee et al. | 347/102 |
| 2003/0184632 | A1 * | 10/2003 | Suzuki et al. | 347/102 |
| 2003/0189609 | A1 * | 10/2003 | Ishikawa | 347/11 |
| 2004/0196322 | A1 * | 10/2004 | Nakajima et al. | 347/14 |
| 2006/0238591 | A1 * | 10/2006 | Matsuhashi et al. | 347/102 |
| 2007/0097197 | A1 * | 5/2007 | Kremers | 347/102 |
| 2007/0153074 | A1 | 7/2007 | Anderson et al. | |
| 2009/0021550 | A1 | 1/2009 | Leighton et al. | |
| 2009/0244236 | A1 | 10/2009 | Houjou | |
| 2011/0298876 | A1 * | 12/2011 | Takeuchi et al. | 347/102 |

FOREIGN PATENT DOCUMENTS

| | | | |
|---|---|---|---|
| JP | 58110257 | A | 6/1983 |
| JP | 62135369 | A | 6/1987 |
| JP | 2005096373 | A * | 4/2005 |

* cited by examiner

*Primary Examiner* — Stephen Meier
*Assistant Examiner* — Leonard S Liang

(57) ABSTRACT

A system for pre-heating print media includes a carriage: a plurality of printheads disposed on the carriage; and a plurality of heating lamps disposed on the carriage such that each of the printheads is associated with at least one of the heating lamps. Each of the heating lamps heats a corresponding portion of a print medium prior to arrival of a printhead associated with that heating lamp at that portion of the print medium.

22 Claims, 3 Drawing Sheets

PRE-HEATING PRINT MEDIA

BACKGROUND

Many printing systems work by selectively ejecting ink from a number of printheads moving in relation to a print medium. The printheads are attached to a movable platform referred to as a carriage. As the carriage moves in relation to the print medium, nozzles of the printheads eject ink or another marking fluid in a predetermined manner so as to form the desired image on the print medium.

Many types of marking fluids used in various printing systems are heated to a particular temperature so that they adhere properly to the print medium on which they are being placed. An efficient way of heating an ink droplet after it has been ejected from a printhead is to heat the print medium on which the ink droplet lands. Upon landing, the ink droplet will then absorb heat from the print medium.

BRIEF DESCRIPTION OF THE DRAWINGS

The accompanying drawings illustrate various embodiments of the principles described herein and are a part of the specification. The illustrated embodiments are merely examples and do not limit the scope of the claims.

Throughout the drawings, identical reference numbers designate similar, but not necessarily identical, elements.

DETAILED DESCRIPTION

Figure 1A:
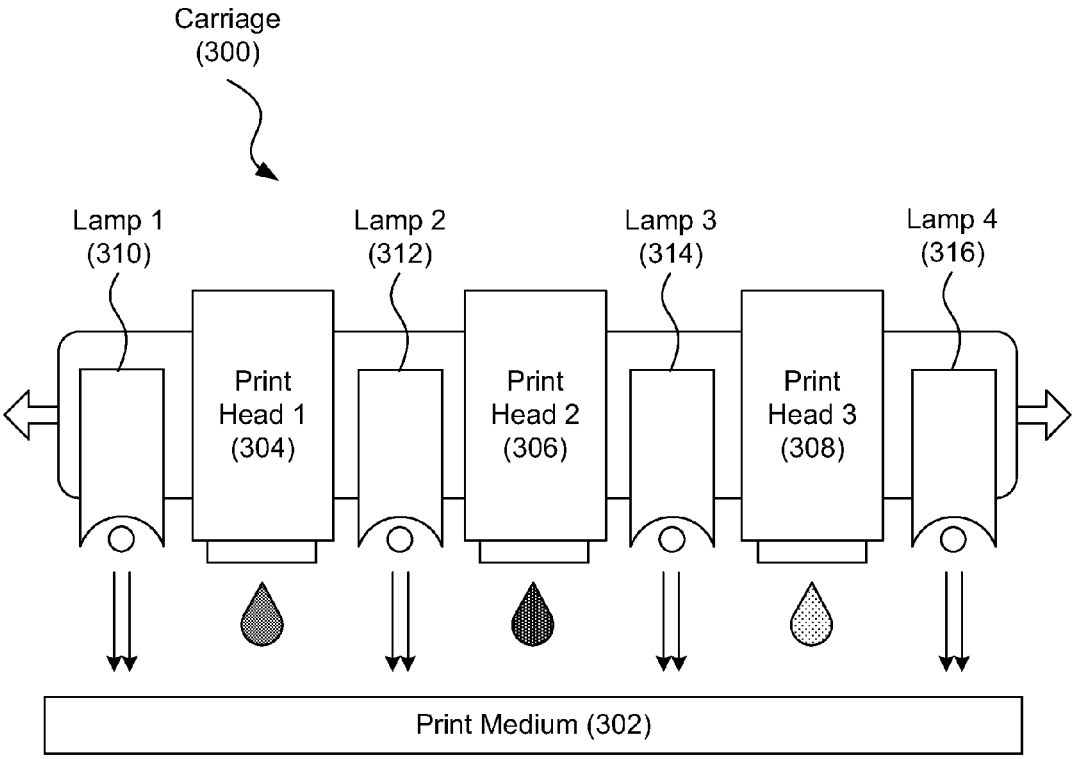
FIG. 1A is a diagram showing an illustrative carriage with multiple heating lamps, according to one example of principles described herein.

As mentioned above, a print medium may be heated to provide thermal energy to a marking fluid being placed on that print medium which will, in turn, improve the performance of the marking fluid on that print medium. For example, a print medium may be heated through use of a heat lamp.

In some possible implementations of this principle, a heating lamp may heat the entire width of the print medium being fed into the printing system. However, this implementation wastes power as parts of the print medium where no ink will be placed are heated without then providing useful thermal energy to the deposited marking fluid. Furthermore, the time between heating the print medium and placing the marking fluid may be long enough to allow the print medium to begin cooling down, requiring more thermal energy to be output by the heating lamps so that the print medium is still sufficiently heated when the marking fluid is deposited.

In another possible implementation, a heating lamp may be disposed on the leading edge of the carriage that is transporting the printheads. The leading edge of a carriage will change as the carriage reverses its direction. This approach heats up the print medium in the proper location, i.e., right before the ink is ejected from the printheads. However, the temperature of the print medium drops rapidly when the heating lamp is no longer being directed at that specific location on the print medium. Consequently, if multiple printheads are attached to the same carriage, the print medium may have cooled below an optimal temperature by the time the printheads which are farthest away on the carriage from the heating lamp eject marking fluid. Thus, the marking fluid droplets from those printheads may not absorb enough heat to optimally adhere to the print medium.

In light of this and other issues, the present specification discloses methods and systems for pre-heating a specific portion of a print medium immediately before a marking fluid, such as ink, is ejected onto that portion of the print medium. According to certain illustrative examples, a carriage including multiple printheads also includes a heating lamp associated with and placed in front of each of the printheads. Thus, each heating lamp applies thermal energy to a portion of the print medium. This brings the print medium to the desired temperature for droplets of marking fluid being ejected from a printhead associated with that heating lamp.

Through use of a method or system embodying principles described herein, droplets ejected from each of the printheads on a carriage can absorb a specified amount of heat from a pre-heated print medium upon landing. This can provide a higher image quality without sacrifice in throughput. Additionally, the heating lamps may operate at reduced heat levels as the heating lamps are closer to the printheads ejecting the marking fluid. This helps reduce the power consumption of the printing system.

In the following description, for purposes of explanation, numerous specific details are set forth in order to provide a thorough understanding of the present systems and methods. It will be apparent, however, to one skilled in the art that the present apparatus, systems and methods may be practiced without these specific details. Reference in the specification to "an embodiment," "an example" or similar language means that a particular feature, structure, or characteristic described in connection with the embodiment or example is included in at least that one embodiment, but not necessarily in other embodiments. The various instances of the phrase "in one embodiment" or similar phrases in various places in the specification are not necessarily all referring to the same embodiment.

Throughout this specification and in the appended claims, the terms "front" and "back" are used to describe different parts of a carriage relative to direction in which the carriage is moving. For example, the front end of the carriage is the leading edge of the carriage as the carriage moves. The "front" and "back" of the carriage will change each time the carriage reverses direction.

FIG. 1A is a diagram showing an illustrative carriage (300) with heating lamps (310-316) placed between the printheads. According to certain illustrative examples, the carriage (300) includes three printheads (304, 306, 308). Each printhead can eject a different color or different type of marking fluid. Additionally, lamps (310, 312, 314, 316) are placed between each of the printheads (304, 306, 308) as well as on both ends of the carriage (300). The direction of movement of the carriage (300) determines which end lamp (310,316) is at the leading edge of the carriage (300).

Depending on which direction the carriage (300) is moving, lamps that precede a print head to a target location can act as heating lamps. While lamps that follow a print head past a target location can act as drying lamps. In some cases, the lamp at the rear that does not precede any print head over a target location on the print medium (302) is simply turned off to conserve power. In other cases, the lamp at the rear of the carriage is left on to help dry the marking fluids after they have been deposited onto the print medium (302).

A lamp acting as a drying lamp can be given a different power setting than when that lamp acts as a heating lamp. The power setting for the drying lamp may be designed to dry the marking fluid properly without adversely affecting the marking fluid.

According to one illustrative example, if lamp 1 (310) is at the leading edge of the carriage (300), then lamp 1 (310) is used to heat the print medium (302) for printhead 1 (304), lamp 2 (312) is used to heat the print medium (302) for printhead 2 (306), lamp 3 (314) is used to heat the print medium (302) for printhead 3 (308), and lamp 4 (316) is used as the drying lamp or may be deactivated to conserve power. Conversely, if lamp 4 (316) is at the leading edge of the carriage (300), then lamp 4 (316) is used to heat the print medium (302) for printhead 3 (308), lamp 3 (314) is used to heat the print medium (302) for printhead 2 (306), lamp 2 (312) is used to heat the print medium (302) for printhead 1 (304), and lamp 1 (310) is used as a drying lamp or deactivated to conserve power.

The lamps (310, 312, 314, 316) can be any suitable type of heat source including, but not limited to, an infrared lamp and a laser device. One type of laser device which may be used is a solid-state laser. A solid-state laser is one in which the gain medium is a solid rather than a liquid or a gas used in most types of lasers. The wavelength at which a solid-state laser operates will affect how well the print medium absorbs thermal energy radiating from the solid-state laser device. For example, if the solid-state laser were able to operate at a wavelength of 3.4 micrometers, then the frequency associated with that wavelength would be well suited for absorption by the molecules of typical print medium materials. This is because the vibration frequencies of the molecules of most print medium types absorb thermal energy well at that wavelength. The vibration frequency of water molecules will absorb thermal energy well from a solid-state laser operating at a 3 micrometer wavelength. A lamp may also include reflectors designed to direct the heat from the lamp at a specific direction from the carriage (300). Each lamp (310, 312, 314, 316) as illustrated in FIG. 1A may indicate a set of lamps.

Although only three printheads (304, 306, 308) are illustrated in FIG. 1A, any practical number of printheads may be used. In some cases, each printhead (304, 306, 308) as illustrated in FIG. 1A may include a group of printheads.

With lamps (310, 312, 314, 316) disposed between each of the printheads (304, 306, 308), the print medium (302) can be brought to a specific temperature for each printhead. In some cases, the specified temperature can be the same for each printhead.

In some cases, each of the heating lamps can be operating at different levels of heat, causing the print medium to be at a different temperature for the different printheads. This is beneficial if the different marking fluids within the different printheads have different physical or chemical properties. For example, the ideal temperature for the marking fluid in printhead 1 (304) might be different than the ideal temperature for the marking fluid in printhead 2 (306). Consequently, it would be beneficial to bring the print medium (302) to a different temperature for printhead 1 (304) than printhead 2 (306).

Figure 1B:
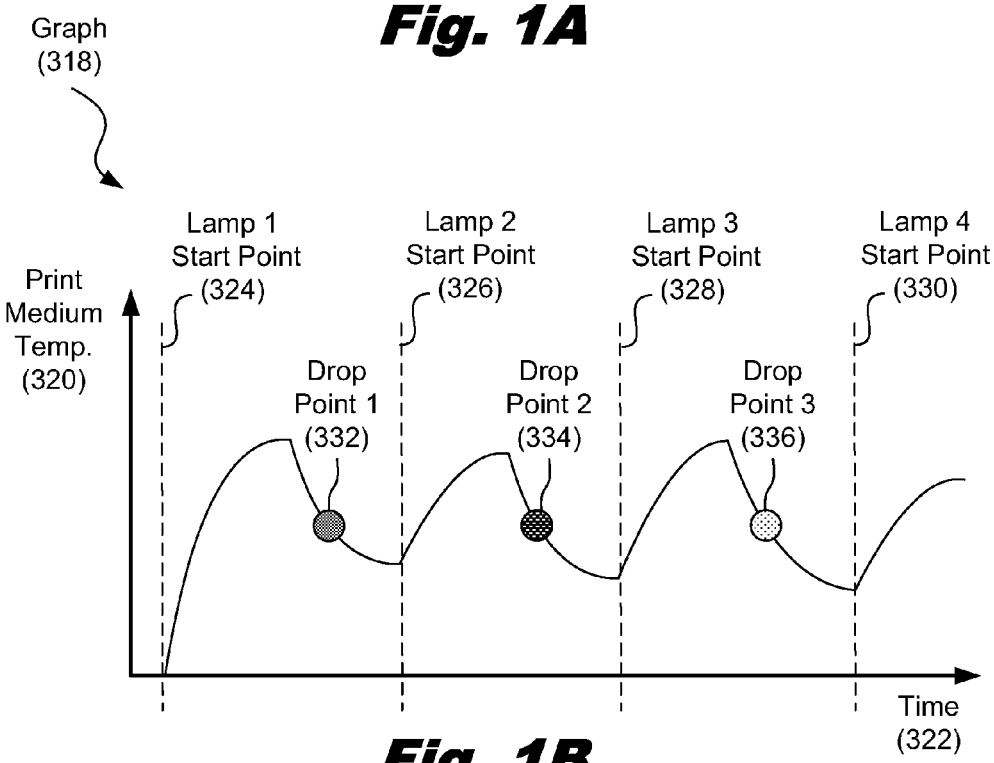
FIG. 1B is a graph showing illustrative print medium temperatures caused by the carriage of FIG. 1A, according to one example of principles described herein.

FIG. 1B is a graph (318) showing illustrative print medium temperatures (320) caused by the carriage (300) of FIG. 1A. The vertical axis represents the print medium temperature (320) at a specific location on the print medium (302). The horizontal axis represents time (322) as the carriage (300) is passing over the specific location of the print medium (302). As above, this specific location will be referred to as the target location. The following is a description of the print medium temperature (320) at the target location as the carriage (300) passes over that location in a direction causing lamp 1 (310) to be at the leading end of the carriage (300).

The lamp 1 start point (324) indicates the point in time at which lamp 1 (310) moves over the target location and begins to heat the print medium (302). After lamp 1 (324) passes the target location, the print medium temperature (320) begins to drop. Drop point 1 (332) indicates the point in time at which printhead 1 (304) ejects its marking fluid.

As the carriage (300) moves past the target location, the print medium temperature (320) continues to drop until lamp 2 (312) passes over the target location. Lamp 2 start point (326) indicates the point in time at which lamp 2 (312) passes over the target location. At this point (326), the print medium temperature (320) rises again until lamp 2 (312) passes the target location. The print medium temperature (320) then again starts to drop and printhead 2 ejects its marking fluid at drop point 2 (334).

This same process is again repeated at lamp 3 start point (328) as lamp 3 (314) heats the print medium (302) for printhead 3 (308) to eject its marking fluid at drop point 3 (336). The lamp 4 start point (330) indicates the point in time at which lamp 4 (316), acting as a drying lamp, begins the drying process.

Figure 2:
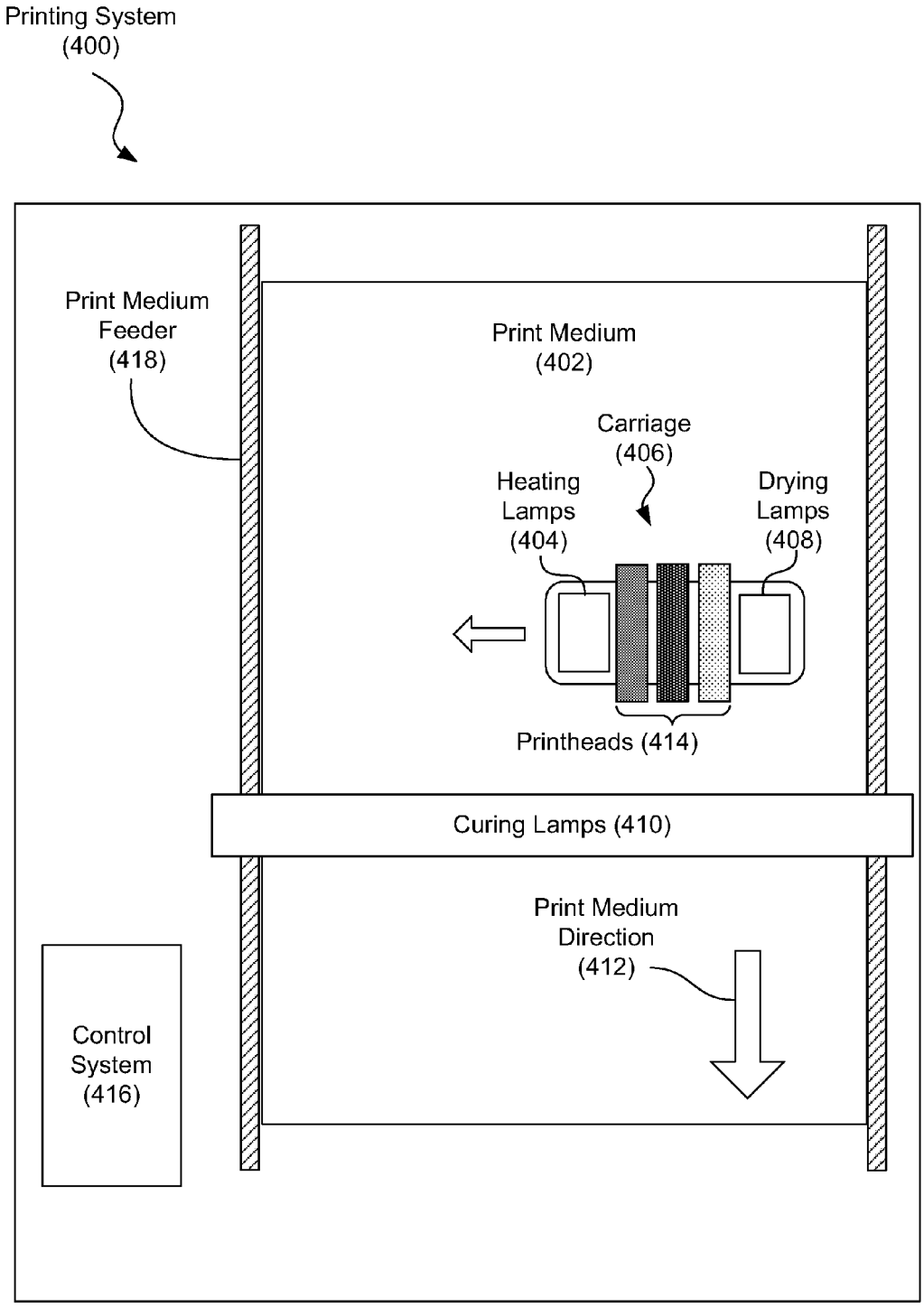
FIG. 2 is a diagram showing an illustrative printing system using the carriage of FIG. 1A, according to one example of principles described herein.

FIG. 2 is a diagram showing an illustrative printing system (400) using the carriage of FIG. 1A. According to certain illustrative examples, with the heating lamps (404) and drying lamps (408) secured to the carriage (406), there is no need for an array of heating lamps and drying lamps extending the width of the print medium (402).

The printing process performed by the printing system (400) starts by having a print medium (402) fed through the printing system (400) by a print medium feeder (418). The print medium (402) then passes underneath the carriage (406).

The carriage (300) is moving in a direction perpendicular to the print medium direction (412). As the carriage moves, the heating lamps (404) at the leading edge of the moving carriage (300) heat the print medium (402) to a specified temperature.

As mentioned above, the heat from the print medium (402) is absorbed by the marking fluid droplets ejected from the printheads (414) onto the print medium (402). The absorbed heat allows the marking fluid droplets to adjust their characteristics so that they provide a higher quality image on the print medium (402).

After the marking fluid has been ejected onto the print medium (402), the drying lamps on the rear of the carriage (406) will dry the marking fluid. The drying process further adds to the image quality. The print medium (402) will then continue to move and the dried marking fluid will pass under an array of curing lamps (410). The curing lamps (410) will help solidify the bond between the marking fluid and the print medium (402).

The printing system (400) is run by a control system (416). In some cases, the control system (416) can be used to pre-set the intensity of heat each heating lamp (404) should emit. The pre-setting can be done based on a number of factors including, but not limited to, the print medium type, marking fluid properties, ambient temperatures, and printer settings.

Pre-setting the intensity at which the heating lamps emit heat removes the need for a feedback control system. A feedback control system measures the actual temperatures and compares it with the desired temperature. The feedback control system can then adjust the heat intensity of the lamps by the difference between the desired and measured temperatures. Such a feedback control system requires the use of several additional components which add to the cost of the printer. By allowing the heat intensity settings of the lamps to be pre-set to account for the various factors listed above, no feedback control system is needed.

Figure 3:
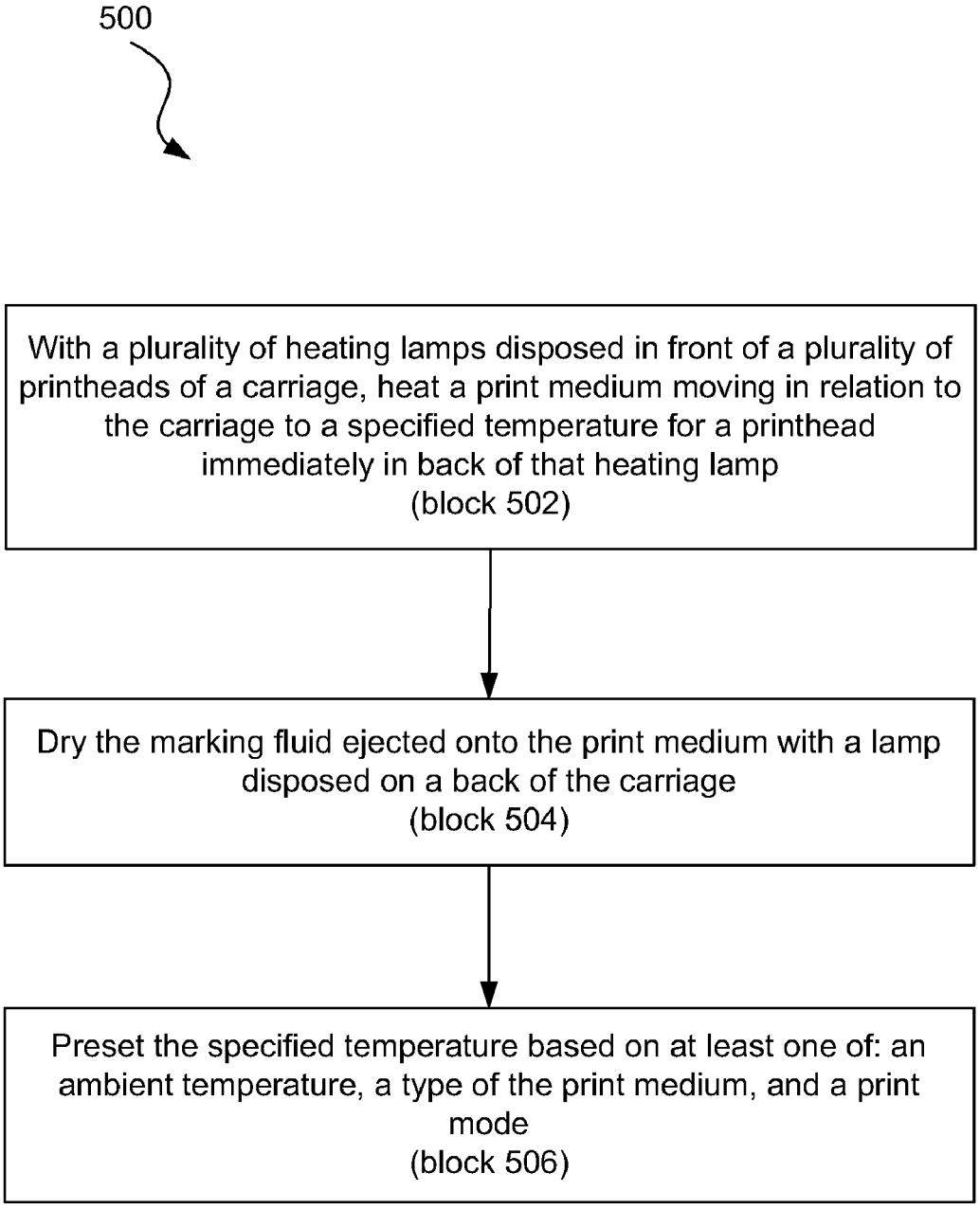
FIG. 3 is a flowchart showing an illustrative method for pre-heating a print medium, according to one example of principles described herein.

FIG. 3 is a flowchart showing an illustrative method for pre-heating a print medium. According to certain illustrative examples, the method includes, with a plurality of heating lamps disposed in front of a plurality of printheads of a carriage, heating (block 502) a print medium moving in relation to the carriage to a specified temperature for a printhead immediately in back of that heating lamp; drying (block 504) the marking fluid ejected onto the print medium with a lamp disposed on a back of the carriage; and presetting (block 506) the specified temperature based on at least one of: an ambient temperature, a type of the print medium, and a print mode.

Through use of a method or system embodying principles described herein, marking fluid droplets ejected from each of the printheads on a carriage can absorb a specified amount of heat from a pre-heated print medium upon landing. This can provide a higher image quality without sacrifice in throughput. Furthermore, the power required to heat the print medium is not wasted by heating locations on the print medium where no marking fluid will be placed.

The preceding description has been presented only to illustrate and describe embodiments and examples of the principles described. This description is not intended to be exhaustive or to limit these principles to any precise form disclosed. Many modifications and variations are possible in light of the above teaching.

What is claimed is:

1. A system for pre-heating print media comprising:

a carriage;

a plurality of printheads disposed on the carriage; and a plurality of heating lamps disposed on the carriage such that each of said printheads is associated with at least one of said heating lamps;

wherein each of the heating lamps heats a corresponding portion of a print medium prior to arrival of a printhead associated with that heating lamp at that portion of the print medium.

2. The carriage of claim 1, in which said heating lamps heat portions of said print medium to a same temperature for all of said printheads.

3. The carriage of claim 1, in which said heating lamps heat portions of said print medium to different temperatures for different printheads.

4. The carriage of claim 3, in which said different temperature for each of said printheads is based on properties of marking fluid being ejected from that printhead.

5. The carriage of claim 1, further comprising a drying lamp disposed on the carriage such that motion of the carriage causes the drying lamp to dry portions of the print medium on which the printheads have printed.

6. The carriage of claim 1, in which said at least one of said heating lamps is disposed between adjacent printheads.

7. The carriage of claim 1, in which at least one of said heating lamps is a solid-state laser.

8. The carriage of claim 1, in which each of said printheads ejects a different color of marking fluid.

9. The system of claim 1, wherein one of said heating lamps is disposed on each side of each of said plurality of printheads disposed on the carriage.

10. The system of claim 1, wherein one of said heating lamps at the trailing edge of the carriage is deactivated to conserve power.

11. A method for pre-heating a print medium before marking fluid is placed onto the print medium, the method comprising:

with each of a plurality of heating lamps disposed on a carriage, each heating lamp associated with one of a plurality of printheads on said carriage, heating a portion of a print medium prior to arrival of a corresponding printhead at said portion of the print medium due to movement of the carriage.

12. The method of claim 11, in which heating lamps heat a corresponding portion of said print medium to a same temperature for each of said printheads.

13. The method of claim 11, in which each heating lamp heats a corresponding portion of said print medium to a different temperature for, and prior to arrival of, the printhead associated with that heating lamp.

14. The method of claim 13, in which said different temperature for each of said printheads is based on properties of marking fluid being ejected from that printhead.

15. The method of claim 11, further comprising drying marking fluid ejected onto said print medium with a lamp disposed on a back of said carriage.

16. The method of claim 11, in which said heating lamps heat corresponding portions of said print medium to a target temperature based on at least one of: an ambient temperature, a type of said print medium, and a print mode.

17. The method of claim 11, in which at least one of said heating lamps is a solid-state laser.

18. The method of claim 11, in which each of said printheads ejects a different color of marking fluid.

19. A printing apparatus comprising:

a control system;

a carriage comprising:

a plurality of printheads disposed on the carriage; and a plurality of heating lamps disposed on the carriage such that each of said printheads is associated with at least one of said heating lamps;

wherein said control system causes each of said plurality of heating lamps to heat a corresponding portion of a print medium prior to arrival of a printhead associated with that heating lamp at that portion of the print medium due to movement of the carriage.

20. The printing apparatus of claim 19, in which each of said heating lamps heats a portion of said print medium to a different temperature for, and prior to arrival of, the printhead associated with that heating lamp.

21. The printing apparatus of claim 19, further comprising a drying lamp disposed on a back of said carriage.

22. The printing apparatus of claim 21, in which said controller changes a temperature of a said heating lamp such that said heating lamp then functions as said drying lamp.

* * * * *